US010316839B2

(12) United States Patent
Brown et al.

(10) Patent No.: US 10,316,839 B2
(45) Date of Patent: Jun. 11, 2019

(54) PUMP PLUNGER FOR A LINEARLY ACTUATED PUMP

(71) Applicant: Caterpillar Inc., Peoria, IL (US)

(72) Inventors: Aaron M. Brown, Peoria, IL (US); Alan R. Stockner, Metamora, IL (US)

(73) Assignee: Caterpillar Inc., Deerfield, IL (US)

( * ) Notice: Subject to any disclaimer, the term of this patent is extended or adjusted under 35 U.S.C. 154(b) by 150 days.

(21) Appl. No.: 15/378,240

(22) Filed: Dec. 14, 2016

(65) Prior Publication Data

US 2018/0163718 A1 Jun. 14, 2018

(51) Int. Cl.

| | |
|---|---|
| ***F04B 1/12*** | (2006.01) |
| ***F04B 53/14*** | (2006.01) |
| ***F04B 19/22*** | (2006.01) |
| ***F04B 53/00*** | (2006.01) |
| ***F04B 53/16*** | (2006.01) |
| ***F04B 1/14*** | (2006.01) |
| *F04B 9/10* | (2006.01) |

(52) U.S. Cl.

CPC ..... *F04B 53/14* (2013.01); *F04B 1/124* (2013.01); *F04B 1/128* (2013.01); *F04B 1/14* (2013.01); *F04B 1/143* (2013.01); *F04B 1/145* (2013.01); *F04B 19/22* (2013.01); *F04B 53/007* (2013.01); *F04B 53/16* (2013.01); *F04B 9/10* (2013.01)

(58) Field of Classification Search

CPC ..... F16J 1/001; F01B 3/0085; F04B 1/124

See application file for complete search history.

(56) References Cited

U.S. PATENT DOCUMENTS

| | | | | |
|---|---|---|---|---|
| 2,721,519 | A * | 10/1955 | Henrichsen | F01B 3/0032 184/109 |
| 6,016,739 | A * | 1/2000 | Baehler | F04B 1/124 92/172 |
| 2016/0069344 | A1 | 3/2016 | Carey et al. | |
| 2016/0222949 | A1 | 8/2016 | Steffen et al. | |
| 2016/0222959 | A1 | 8/2016 | Campion et al. | |

FOREIGN PATENT DOCUMENTS

| | | | |
|---|---|---|---|
| DE | 102008029071 | A1 | 12/2009 |
| DE | 102011119775 | A1 | 6/2013 |
| JP | 5071401 | | 11/2012 |
| KR | 1020150083061 | | 7/2015 |
| KR | 1020150095421 | | 8/2015 |

* cited by examiner

*Primary Examiner* — F Daniel Lopez
(74) *Attorney, Agent, or Firm* — Miller, Matthias & Hull

(57) ABSTRACT

A pump plunger is disclosed. The plunger may include a proximal end and a distal end opposite the proximal end. The plunger may also include a body portion extending between the proximal end and a second transition datum, and additionally include a transition section extending between a first transition datum and the second transition datum. The transition section may have a non-linear geometric profile. A first shoulder portion may be positioned adjacent to the transition section that may extend between the second transition datum and a third datum. The third datum may be positioned radially inward of the second transition datum. The plunger may also include a tip portion positioned adjacent to the first shoulder portion that may extend between the third datum and a fourth datum positioned at the distal end. The fourth datum may be positioned radially inward of the third datum.

14 Claims, 6 Drawing Sheets

PUMP PLUNGER FOR A LINEARLY ACTUATED PUMP

TECHNICAL FIELD

This disclosure generally relates to a linearly actuated pump and, more particularly, to a pump plunger for a linearly actuated pump.

BACKGROUND

Generally speaking, a linearly actuated pump includes a drive assembly operatively engaged with a pumping assembly. The pumping assembly generally includes a barrel having a bore extending therethrough, a head having a chamber for pressurization of a fluid, and a pump plunger positioned within the bore. The drive assembly provides reciprocating linear motion to the pump plunger, thereby causing it to reciprocate within the bore.

While the pump plunger is moving in a pressurization stroke or pumping direction, at least some of the energy added to the fluid is transferred to the barrel and the pump plunger, the pressure of the fluid increases, the walls of the barrel may elastically deform and expand outwardly due to the pressure increase, and the temperature of the fluid increases. Likewise, the pump plunger may also elastically deform resulting in an increased diameter.

However, since the barrel has greater mass than the pump plunger, and because it is immersed in the fluid, the barrel does not deform an equal amount as the pump plunger. Thus, as the pressure decreases on a return and filling stroke, the walls of the barrel may substantially return to their original configuration, while the pump plunger remains in an expanded state. Therefore, the pump plunger may rub or scuff the barrel on the return stoke, thereby reducing service life of the linearly actuated pump.

US Patent Application Publication US 2016/0222959 to Campion et al. ("Campion") discloses a cryogenic piston pump with a barrel, a head with a bore, and a pump plunger slidably disposed within the bore. The pump plunger may be coated with tribological coating main layer, and a sacrificial break-in layer placed on the main layer that may also include a tribological coating, to thereby reduce rubbing, scuffing, and seizure of pump plungers and barrels.

The present disclosure is directed to overcoming one or more problems set forth above and/or other problems associated with the prior art.

SUMMARY

In accordance with one aspect of the present disclosure, a pump plunger is disclosed. The pump plunger may include a proximal end and a distal end opposite the proximal end. The pump plunger may also include a body portion extending between the proximal end and a second transition datum, and additionally include a transition section extending between a first transition datum and the second transition datum. The transition section may have a non-linear geometric profile. A first shoulder portion may be positioned adjacent to the transition section that may extend between the second transition datum and a third datum. The third datum may be positioned radially inward of the second transition datum. The pump plunger may also include a tip portion positioned adjacent to the first shoulder portion that may extend between the third datum and a fourth datum positioned at the distal end. The fourth datum may be positioned radially inward of the third datum.

In accordance with another aspect of the present disclosure, a pumping assembly is disclosed. The pumping assembly may include a head, a barrel, and a pump plunger. The head may include a chamber for pressurizing a fluid, and the barrel may have a bore extending therethrough. The pump plunger may include a proximal end and a distal end opposite the proximal end. The pump plunger may also include a body portion extending between the proximal end and a second transition datum, and additionally include a transition section extending between a first transition datum and the second transition datum. The transition section may have a non-linear geometric profile. A first shoulder portion may be positioned adjacent to the transition section that may extend between the second transition datum and a third datum. The third datum may be positioned radially inward of the second transition datum. The pump plunger may also include a tip portion positioned adjacent to the first shoulder portion that may extend between the third datum and a fourth datum positioned at the distal end. The fourth datum may be positioned radially inward of the third datum.

In accordance with another embodiment of the present disclosure, a linearly actuated pump is disclosed. The linearly actuated pump may include a drive assembly and a pumping assembly. The pumping assembly may include a head, a barrel, and a pump plunger. The head may include a chamber for pressurizing a fluid, and the barrel may have a bore extending therethrough. The pump plunger may include a proximal end and a distal end opposite the proximal end. The pump plunger may also include a body portion extending between the proximal end and a second transition datum, and additionally include a transition section extending between a first transition datum and the second transition datum. The transition section may have a non-linear geometric profile. A first shoulder portion may be positioned adjacent to the transition section that may extend between the second transition datum and a third datum. The third datum may be positioned radially inward of the second transition datum. The pump plunger may also include a tip portion positioned adjacent to the first shoulder portion that may extend between the third datum and a fourth datum positioned at the distal end. The fourth datum may be positioned radially inward of the third datum.

These and other aspects and features of the present disclosure will be more readily understood when read in conjunction with the accompanying drawings.

BRIEF DESCRIPTION

DETAILED DESCRIPTION OF THE DISCLOSURE

Figure 1:
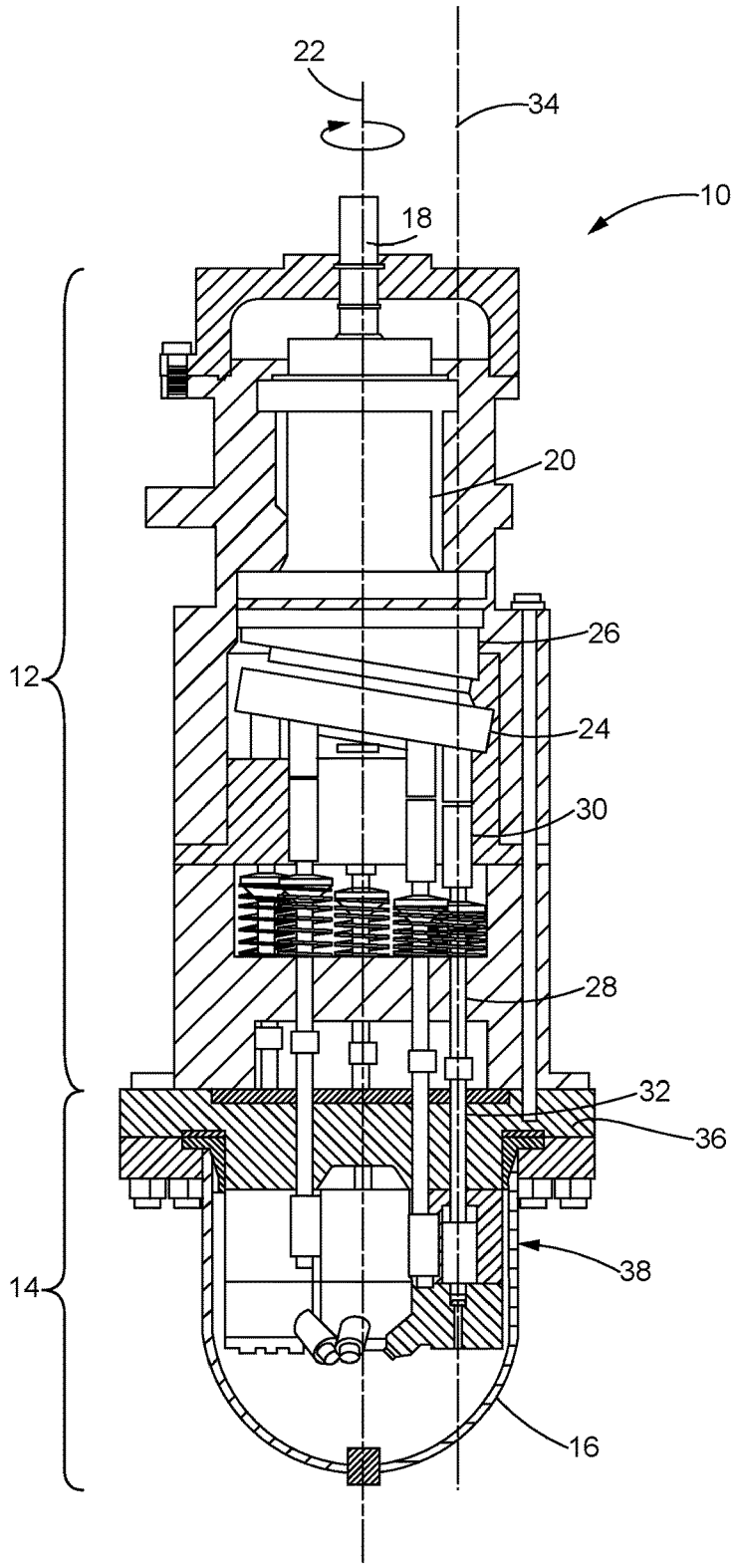
FIG. 1 is a cross-sectional view of a linearly actuated pump in accordance with the present disclosure.

Referring now to the drawings, and with specific reference to FIG. 1, a linearly actuated pump is depicted and generally referred to by reference number 10. As is depicted therein, the linearly actuated pump 10 may be subdivided into a drive assembly 12 and a pumping assembly 14. The pumping assembly 14 may be configured for submersion in a tank or within a reservoir 16 as is depicted.

The drive assembly 12 may include a stub shaft 18 operatively connected to a drive shaft 20, both of which are rotatable about a longitudinal axis 22. The drive shaft 20 may be operatively coupled with a loadplate 24 via a wobble plate 26. Each of the loadplate 24 and the wobble plate 26 may be rotatable about the longitudinal axis 22. The loadplate 24 may be operatively engaged with an upper push rod 28 via a tappet 30. In turn, a lower push rod 32 may be operatively engaged with the loadplate 24 via the upper push rod 28 and the tappet 30. As the loadplate 24 rotates, the tappet 30, the upper push rod 28 and the lower push rod 32 may reciprocate along an axis of reciprocating motion 34 that is parallel to the longitudinal axis 22. Alternatively, the linearly actuated pump 10 may be hydraulically driven. For example, the drive assembly 12 may include a cylinder and piston (not shown) configured to operatively engage the lower push rod 32 and set the pumping assembly 14 in motion.

Figure 2:
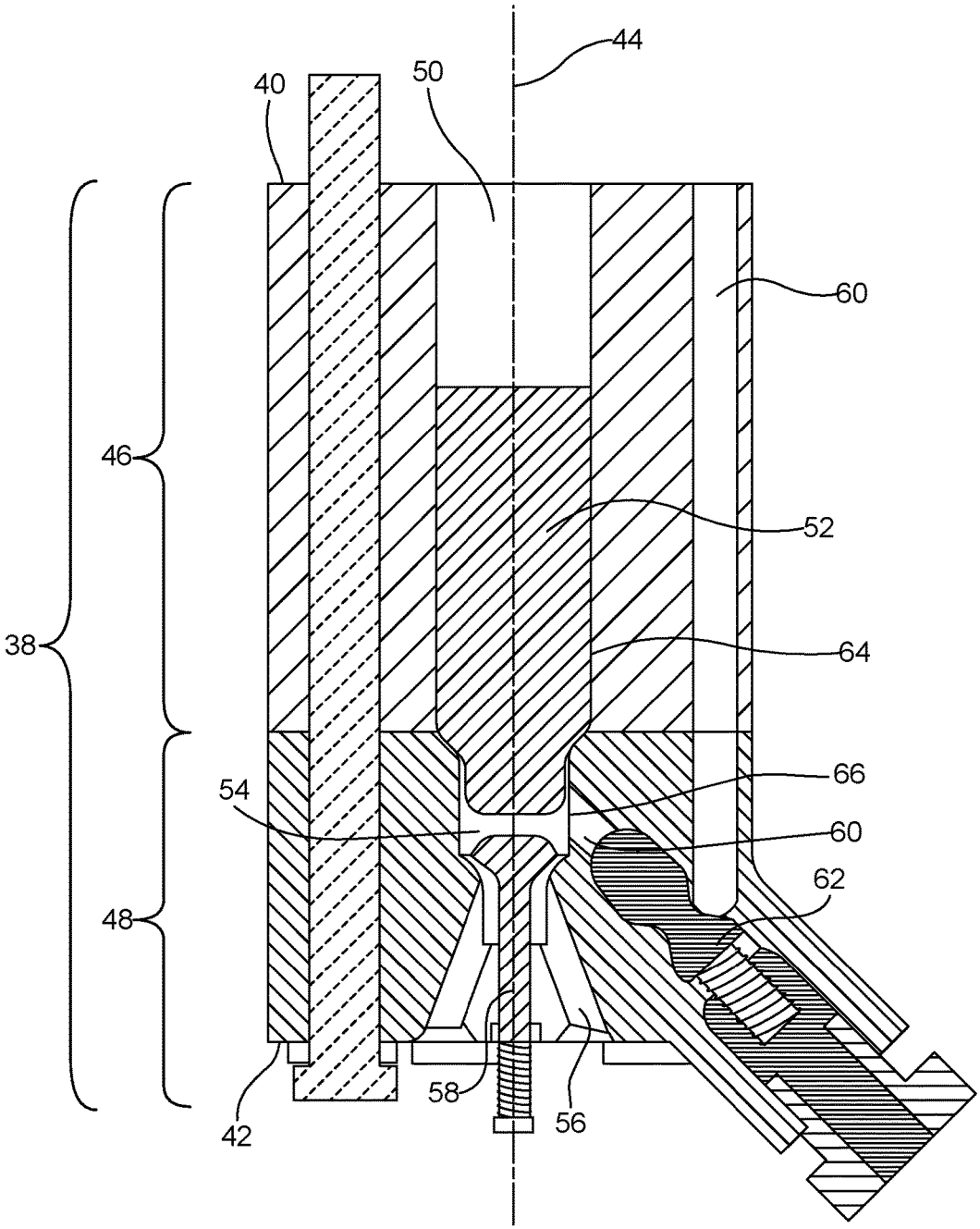
FIG. 2 is a cross-sectional view of a barrel assembly that may be used in conjunction with the linearly actuated pump of FIG. 1.

The pumping assembly 14 may include a manifold 36 operatively connected to the drive assembly 12, and a barrel assembly 38 configured to pressurize a fluid, and more particularly, a cryogenic fluid. The barrel assembly 38 may be submerged in a tank including the fluid, or in the reservoir 16, as is shown. The barrel assembly 38 is depicted in greater detail in FIG. 2.

The barrel assembly 38 may extend between a proximal side 40 and a distal side 42 opposite the proximal side 40, and the proximal side 40 may be operatively connected to the manifold 36. The barrel assembly 38 defining a barrel axis 44 extending therethrough that maybe collinear with the axis of reciprocating motion 34 and offset from the longitudinal axis 22. Alternatively, however, in the case of the linearly actuated pump 10 having only one barrel assembly 38, the barrel axis 44, the axis of reciprocating motion 34, and the longitudinal axis 22, may all be collinear. The terms "proximal" and "distal" are used herein to refer to the relative positions of the components of the barrel assembly 38. When used herein, "proximal" refers to a position relatively closer to the end of the barrel assembly 38 operatively connected to the manifold 36. In contrast, "distal" refers to a position relatively further away from the end of the barrel assembly 38 operatively connected to the manifold 36.

The barrel assembly 38 may include a barrel 46 positioned at the proximal side 40 and a head 48 positioned at the distal side 42. The head 48 may be operatively attached to the barrel 46 to close off the barrel assembly 38. Alternatively, the barrel assembly 38, including the barrel 46 and the head 48, may be integrally formed as a unitary piece.

A bore 50 may extend through the barrel 46 and be configured to receive a pump plunger 52 that is operatively engaged with the lower push rod 32. A distal side of the bore 50 may form a chamber 54, which may extend into the head 48. The head 48 may further include an inlet passage 56 extending from the distal side 42 and ending at the chamber 54, and an inlet check valve 58 may be located at the junction between the chamber 54 and the inlet passage 56. The inlet check valve 58 may be spring-biased to a closed position that impedes passage of the fluid into the chamber 54 unless the chamber 54 is under a relative negative pressure. In another configuration, the inlet check valve 58 may lack a spring and instead be biased to the closed position due to gravity, and open due to the relative negative pressure.

The head 48 may additionally include an outlet passage 60 extending between the chamber 54 and the proximal side 40 of the barrel assembly 38. An outlet check valve 62 may be positioned in the outlet passage 60. Alternatively, the outlet check valve 62 may be positioned adjacent to the chamber 54. The outlet check valve 62 may be spring-biased to a closed position that impedes passage of the fluid out of the chamber 54 unless the chamber 54 is under a relative positive pressure.

The pump plunger 52 may slidingly reciprocate within the bore 50 between a top position 64 closer to the proximal side 40 and a bottom position 66 closer to the distal side 42. When in the bottom position 66, at least some portion of the pump plunger 52 may be disposed in the chamber 54. On the other hand, when in the top position 64, little or no portion of the pump plunger 52 may be disposed in the chamber 54. When the pump plunger 52 is moving from the top position 64 toward the bottom position 66, the fluid in the chamber 54 is under increasing pressure until reaching maximum pressure at the bottom position 66. Moving from the top position 64 to the bottom position 66 is a pressurization stroke. In contrast, when the pump plunger 52 is moving from the bottom position 66 toward the top position 64, the fluid in the chamber 54 is under decreasing pressure until reaching is minimum value at the top position 64. During this motion, the inlet check valve 58 may be open and therefore admitting liquid into the chamber 54. Moving from the bottom position 66 to the top position 64 is a return and filling stroke.

Figure 3:
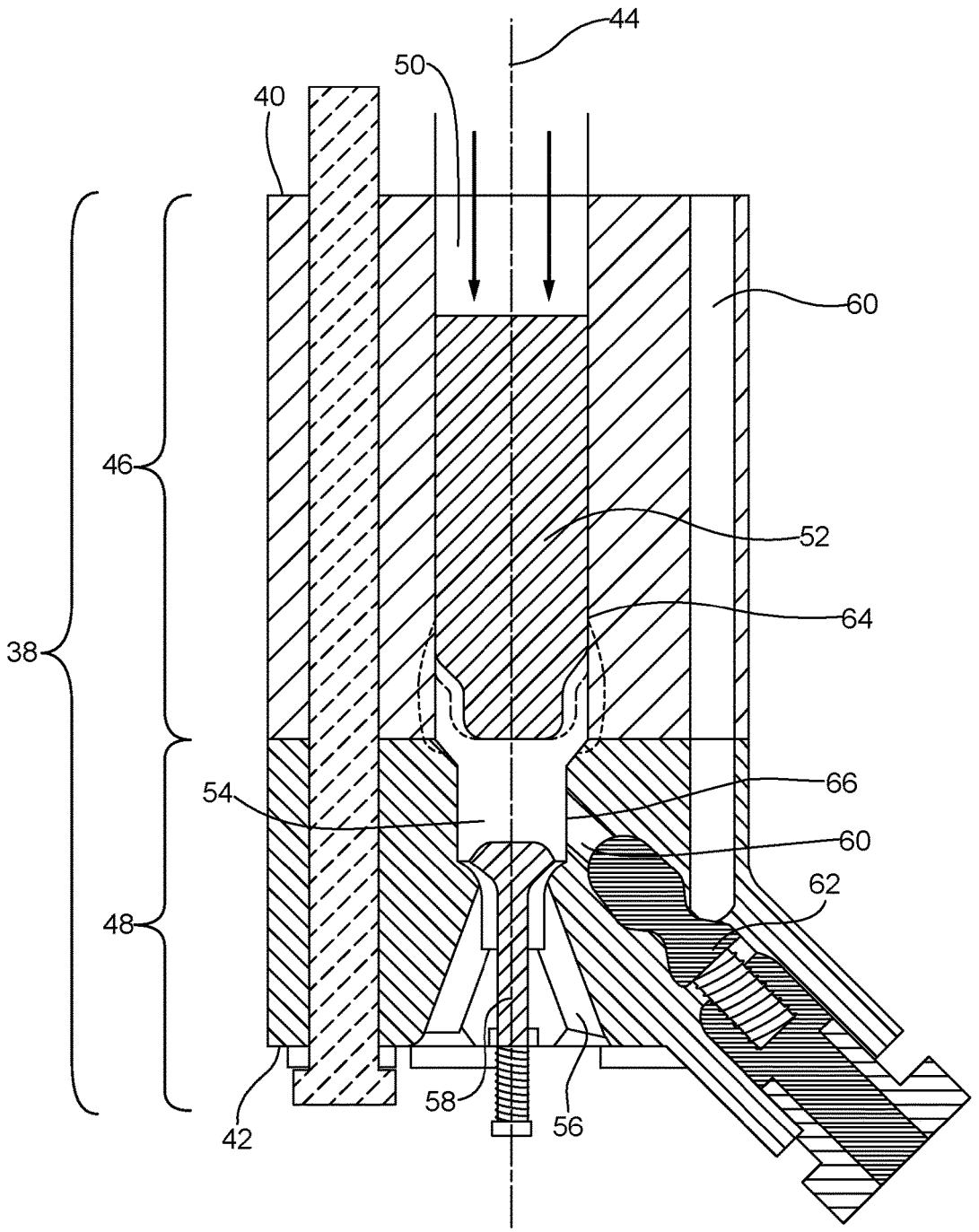
FIG. 3 is a cross-sectional view of the barrel assembly of FIG. 2 during a pressurization stroke.

When the pump plunger 52 is moving from the top position 64 toward the bottom position 66 during the pressurization stroke, energy is added to the fluid in the bore 50 and chamber 54, and at least part of the energy added to the fluid is transferred to the barrel 46 and the pump plunger 52 as thermal energy. In response, and as is depicted by the dashed lines in FIG. 3, the barrel 46 may elastically deform and expand radially outward from its original configuration relative to the barrel axis 44. Similarly, as is also illustrated by the dashed lines in FIG. 3, the pump plunger 52 may elastically deform and expand radially outward relative to the barrel axis 44 due to the energy transfer from the fluid.

However, since the barrel 46 has greater mass than the pump plunger 52, and because it is immersed in the fluid in the tank or reservoir 16, the barrel 46 does not deform an equivalent amount as pump plunger 52. Thus, as the pump plunger 52 is moving from the bottom position 66 toward the top position 64 during the return and filling stroke, the barrel 46 may return to its original configuration relative to the barrel axis 44, while the pump plunger 52 remains in the radially outwardly expanded state. Therefore, the pump plunger 52 may rub, scuff, or possibly seize with, the barrel 46 during the return and filling stroke.

Figure 4:
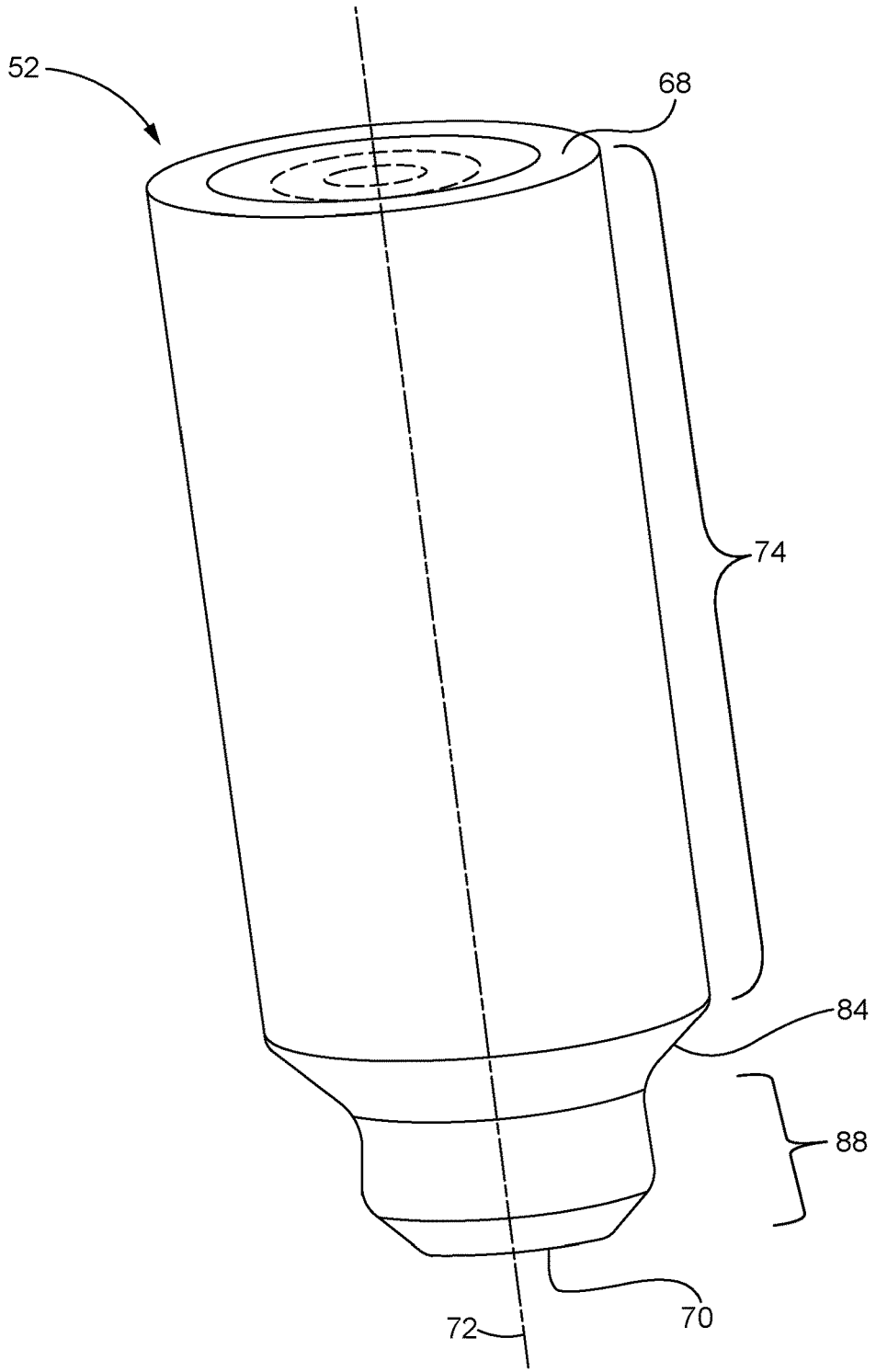
FIG. 4 is a perspective view of a pump plunger that may be used in conjunction with the barrel assembly of FIG. 2.
Figure 5:
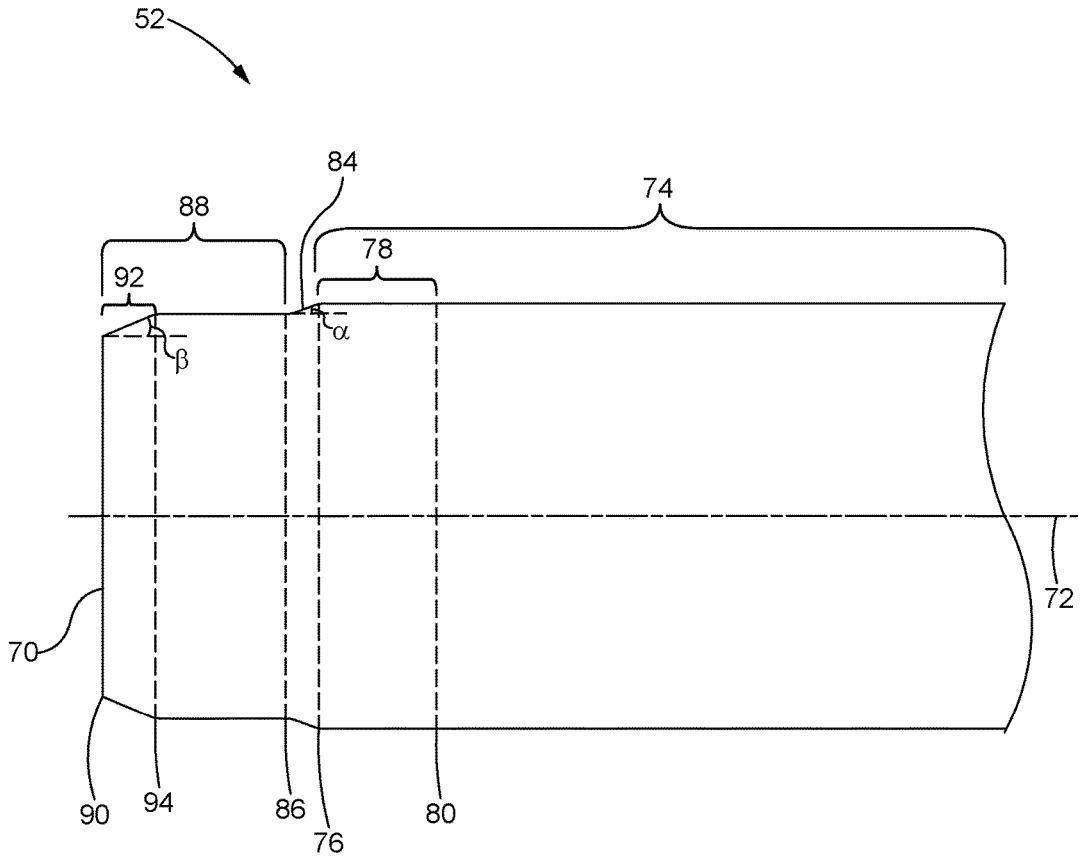
FIG. 5 is a partial profile of the pump plunger of FIG. 3.
Figure 6:
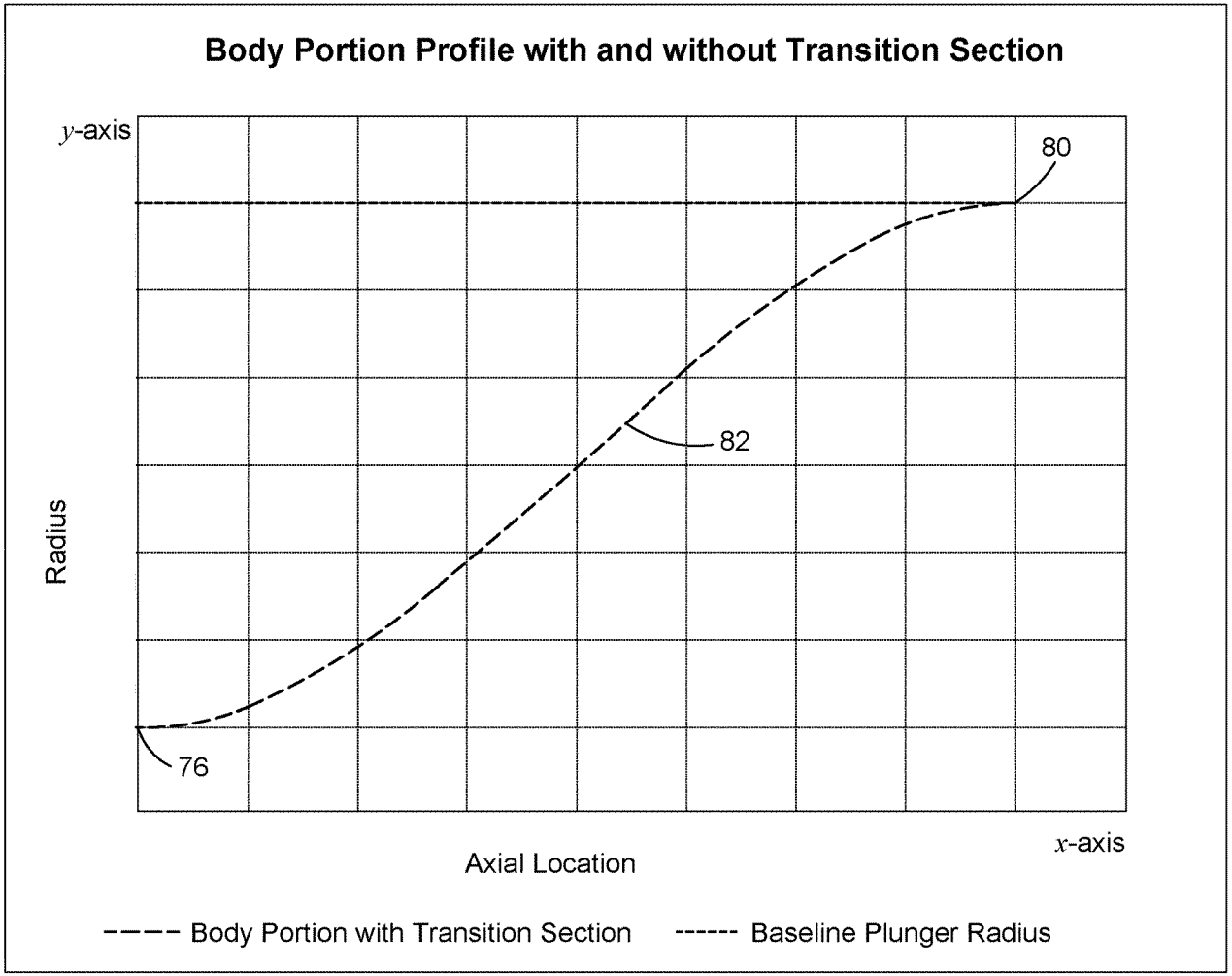
FIG. 6 is a graphical representation illustrating a non-linear geometric profile of a transition section of the pump plunger of FIG. 5.

The present disclosure is directed toward a pump plunger 52 constructed in accordance with FIGS. 4-6. As illustrated in FIG. 4, the pump plunger 52 may extend between a proximal end 68 and a distal end 70 opposite the proximal end 68. A plunger axis 72 may extend through the proximal end 68 and the distal end 70. Turning to FIGS. 4-5, a body portion 74 may extend between the proximal end 68 and a second transition datum 76. The body portion 74 may include a transition section 78 extending between a first transition datum 80 and the second transition datum 76.

Referring now to FIG. 6, the transition section 78 may have a non-linear geometric profile 82, and the second transition datum 76 may be positioned radially inward of the first transition datum 80 relative to the plunger axis 72. In other words, the radius of the pump plunger 52 at the second transition datum 76 may be less than the radius at the first transition datum 80. In one example, the non-linear geometric profile 82 extending between the first transition datum 80 and the second transition datum 76 may conform to the following equation, where y is the radius of the pump plunger 52 and x is the axial location along the pump plunger 52:

$$y = -\frac{3x^3}{128000} + \frac{9x^2}{32000} - 0.006.$$

However, as is understood by a person of ordinary skill in the art, the non-linear equation describing the non-linear geometric profile 82 may differ due to varying operating conditions. For example, the operating pressure of the pump 10, the chemical composition of the fluid being pumped, the material utilized to manufacture the pump plunger 52, the material utilized to manufacture the barrel 46, and the material utilized to produce the head 48, may each alone, or in combination, affect the non-linear equation describing the non-linear geometric profile 82.

Referring again to FIGS. 4-5, the pump plunger 52 may further include a first shoulder portion 84 positioned adjacent to the transition section 78, that may extend between the second transition datum 76 and a third datum 86 that is positioned radially inward of the second transition datum 76 relative to the plunger axis 72. Accordingly, the radius of the pump plunger 52 at the third datum 86 may be less than the radius at the second transition datum 76. Furthermore, the first shoulder portion 84 may have a linear profile, and extend between the third datum 86 and the second transition datum 76 at an angle $\alpha$ relative to the plunger axis 72. The angle $\alpha$ may range between 15° and 60°.

The pump plunger 52 may further include a tip portion 88 positioned adjacent to the first shoulder portion 84 that may extend between the third datum 86 and a fourth datum 90 positioned at the distal end 70. The fourth datum 90 may be positioned radially inward of the third datum 86 relative to the plunger axis 72. Therefore, the radius of the pump plunger 52 at the fourth datum 90 may be less than the radius at the third datum 86. Moreover, the tip portion 88 may include a second shoulder portion 92 positioned adjacent to the distal end 70, that may extend between a fifth datum 94 and the fourth datum 90. The fourth datum 90 may be positioned radially inward of the fifth datum 94 relative to the plunger axis 72. Therefore, the radius of the pump plunger 52 at the fifth datum 94 may be less than at the third datum 86, and may be greater than the radius at the fourth datum 90. Additionally, the second shoulder portion 92 may have a linear profile, and extend between the fourth datum 90 and the fifth datum 94 at an angle $\theta$ relative to the plunger axis 72. The angle $\theta$ may range between 15° and 60°.

Referring to FIGS. 4-6, the slope of the non-linear geometric profile 82 at the first transition datum 80 is approximately zero. In addition, the slope of the non-linear geometric profile 82 at the second transition datum 76 may be approximately zero. may be approximately zero. Accordingly, the slope of the non-linear geometric profile 82 at the first transition datum 80 is parallel to the slope of the non-linear geometric profile 82 at the second transition datum 76, and both of these slopes may be parallel to the bore 50.

INDUSTRIAL APPLICABILITY

The disclosed plunger and pump finds potential application in any fluid system where heat transfer from a pressurized fluid to the plunger is undesirable. The disclosed plunger and pump finds particular applicability in cryogenic fluid applications, for example, power system applications having engines that combust liquid natural gas as fuel. One skilled in the art will recognize, however, that the disclosed plunger and pump may be utilized in other applications that may or may not be associated with cryogenic fluid applications, and even other applications besides power systems. Operation of the linearly actuated pump 10 will now be described in more detail.

The stub shaft 18 may be rotated about the longitudinal axis 22 by a power source such as, but not limited to, Otto and Diesel cycle internal combustion engines, electric motors, gas turbine engines, and the like. In turn, the drive shaft 20 may rotate the loadplate 24 via the wobble plate 26, thereby converting rotational motion into reciprocating linear motion. The lower push rod 32 may linearly reciprocate along the axis of reciprocating motion 34 via its operative engagement with the loadplate 24 via the upper push rod 28 and the tappet 30.

As the pump plunger 52 is operatively engaged with the lower push rod 32, the pump plunger 52 may slidingly reciprocate along the barrel axis 44 of the barrel assembly 38 between a top position 64 and a bottom position 66 inside the bore 50. When moving the pump plunger 52 from the top position 64 toward the bottom position 66, fluid in the chamber 54 may be under increasing pressurization until reaching maximum pressure at the bottom position 66 during the pressurization stroke. When at the bottom position 66, the relative pressure in the chamber 54 may be at a great enough value to overcome the spring-bias of the outlet check valve 62, and as such, the fluid may exit the chamber 54 through the outlet passage 60, and past the outlet check valve 62, towards the proximal side 40.

In turn, when moving the pump plunger 52 from the bottom position 66 toward the top position 64, decreasing relative pressure inside the chamber 54 may eventually be at a low enough value such that the spring-bias of the outlet check valve 62 overcomes the relative pressure inside the chamber 54, and in turn returns to its closed position, thereby stopping outflow of any fluid in the chamber 54 past the outlet check valve 62 through the outlet passage 60 toward the proximal side 40. Further, the relative pressure inside the chamber 54 may eventually become low enough to overcome the spring-bias of the inlet check valve 58. At this point, fluid in the tank or reservoir 16 may enter the barrel assembly 38 through the inlet passage 56, past the inlet check valve 58, and into the chamber 54 until the lowest relative pressure when the pump plunger 52 is at the top position 64. Then, when moving the pump plunger 52 back toward the bottom position 66, the relative pressure inside the chamber 54 may be great enough to overcome the spring-bias of the inlet check valve 58, thereby stopping the inflow of fluid through the inlet passage 56, past the inlet check valve 58, into the chamber 54.

As described before, the pump plunger 52 may elastically deform and expand radially outward while moving from the top position 64 toward the bottom position 66. Further, the pump plunger 52 may remain in this expanded state when moving from the bottom position 66 toward the top position 64 and may rub, scuff, or possibly seize with, the barrel 46 during this return and filling stroke. However, a pump plunger 52 having the attributes of FIGS. 4-6, including the transition section 78, mitigates this issue and increases service life of the linearly actuated pump 10.

The above description is meant to be representative only, and thus modifications may be made to the embodiments described herein without departing from the scope of the disclosure. Thus, these modifications fall within the scope of present disclosure and are intended to fall within the appended claims.

What is claimed is:

1. A pump plunger, comprising:

a proximal end;

a distal end opposite the proximal end;

a body portion extending between the proximal end and a second transition datum, and including a transition section extending between a first transition datum and the second transition datum, the transition section having a non-linear geometric profile, the second transition datum being positioned radially inward of the first transition datum relative to a plunger axis of the plunger, the slope of the non-linear geometric profile at both the first transition datum and at the second transition datum being zero;

a first shoulder portion positioned adjacent to the transition section extending between the second transition datum and a third datum, the third datum positioned radially inward of the second transition datum relative to the plunger axis; and a tip portion positioned adjacent to the shoulder portion extending between the third datum and a fourth datum positioned at the distal end, the fourth datum positioned radially inward of the third datum relative to the plunger axis.

2. The pump plunger according to claim 1, wherein the non-linear geometric profile extending between the first transition datum and the second transition datum conforms to an equation:

$$y = -\frac{3x^3}{128000} + \frac{9x^2}{32000} - 0.006.$$

where y is a radius of the non-linear geometric profile and x is an axial location of the non-linear geometric profile relative to the plunger axis.

3. The pump plunger according to claim 1, wherein the first shoulder portion has a linear profile and extends at an angle α ranging between 15° and 60° relative to the plunger axis.

4. The pump plunger according to claim 1, further comprising a second shoulder portion adjacent to the distal end and extending between a fifth datum and the fourth datum.

5. The pump plunger according to claim 4, wherein the second shoulder portion has a linear profile and extends at an angle β ranging between 15° and 60° relative to the plunger axis.

6. A pumping assembly, comprising:

a head having a chamber for pressurizing a fluid;

a barrel having a bore extending therethrough; and a pump plunger received in the bore and including a proximal end, a distal end opposite the proximal end, a body portion extending between the proximal end and a second transition datum, and including a transition section extending between a first transition datum and the second transition datum, the transition section having a non-linear geometric profile, the second transition datum being positioned radially inward of the first transition datum relative to a plunger axis of the pump plunger, the slope of the non-linear geometric profile at both the first transition datum and the second transition datum being zero, a first shoulder portion positioned adjacent to the transition section extending between the second transition datum and a third datum, the third datum positioned radially inward of the second transition datum relative to the plunger axis, and a tip portion positioned adjacent to the shoulder portion extending between the third datum and a fourth datum positioned at the distal end, the fourth datum positioned radially inward of the third datum relative to the plunger axis.

7. The pumping assembly according to claim 6, wherein the non-linear geometric profile extending between the first transition datum and the second transition datum conforms to an equation:

$$y = -\frac{3x^3}{128000} + \frac{9x^2}{32000} - 0.006.$$

where y is a radius of the non-linear geometric profile and x is an axial location of the non-linear geometric profile relative to the plunger axis.

8. The pumping assembly according to claim 6, wherein the first shoulder portion has a linear profile and extends at an angle α ranging between 15° and 60° relative to the plunger axis.

9. The pumping assembly according to claim 6, further comprising a second shoulder portion adjacent to the distal end and extending between a fifth datum and the fourth datum.

10. The pumping assembly according to claim 9, wherein the second shoulder portion has a linear profile and extends at an angle β ranging between 15° and 60° relative to the plunger axis.

11. A linearly actuated pump, comprising:

a drive assembly; and a pumping assembly driven by the drive assembly and including a head having a chamber for pressurizing a fluid, a barrel having a bore extending therethrough, and a pump plunger configured to slidingly reciprocate within the bore and including a proximal end, a distal end opposite the proximal end, a body portion extending between the proximal end and a second transition datum, and including a transition section extending between a first transition datum and the second transition datum, the transition section having a non-linear geometric profile, the second transition datum being positioned radially inward of the first transition datum relative to a plunger axis of the pump plunger, the slope of the non-linear geometric profile at both the first transition datum and the second transition datum being zero, a first shoulder portion positioned adjacent to the transition section extending between the second transition datum and a third datum, the third datum positioned radially inward of the second transition datum relative to the plunger axis, and a tip portion positioned adjacent to the first shoulder portion extending between the third datum and a fourth datum positioned at the proximal end, the fourth datum positioned radially inward of the third datum relative to the plunger axis.

12. The linearly actuated pump according to claim 11, wherein the non-linear geometric profile extending between the first transition datum and the second transition datum conforms to an equation:

$$y = -\frac{3x^3}{128000} + \frac{9x^2}{32000} - 0.006.$$

where y is a radius of the non-linear geometric profile and x is an axial location of the non-linear geometric profile relative to the plunger axis.

13. The linearly actuated pump according to claim 11, wherein the first shoulder portion has a linear profile and extends at an angle α ranging between 15° and 60° relative to the plunger axis.

14. The linearly actuated pump according to claim 11, further comprising a second shoulder portion adjacent to the distal end and extending between a fifth datum and the fourth datum, wherein the second shoulder portion has a linear profile and extends at an angle β ranging between 15° and 60° relative to the plunger axis.

* * * * *